US006490735B2

(12) United States Patent
Rindle

(10) Patent No.: US 6,490,735 B2
(45) Date of Patent: Dec. 10, 2002

(54) GARMENT HAVING A COMFORT ELEMENT

(75) Inventor: Markus Rindle, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/729,343

(22) Filed: Dec. 5, 2000

(65) Prior Publication Data

US 2002/0066132 A1 Jun. 6, 2002

(51) Int. Cl.[7] ..... A41D 1/02
(52) U.S. Cl. ..... 2/98; 2/129
(58) Field of Search ..... 2/98, 468, 84, 2/85, 93, 97, 99, 100, 123, 127, 129, 135, 267, 243.1, 162, 244

(56) References Cited

U.S. PATENT DOCUMENTS 3,479,667 A * 11/1969 Mehl ..... 2/65
4,441,211 A * 4/1984 Donzis ..... 2/2
4,601,066 A * 7/1986 Campbell ..... 2/70
4,603,440 A * 8/1986 Hale ..... 2/115
4,604,759 A * 8/1986 Bowman et al. ..... 2/81
5,115,516 A * 5/1992 Golde ..... 2/108
5,167,037 A * 12/1992 Grilliot et al. ..... 2/98
5,274,850 A * 1/1994 Aldridge ..... 2/84
5,369,809 A * 12/1994 Hall ..... 2/202
5,400,438 A * 3/1995 Staff et al. ..... 2/129
5,842,229 A * 12/1998 Snedeker ..... 2/98
5,991,924 A * 11/1999 Grilliot et al. ..... 2/98
6,038,701 A * 3/2000 Regan ..... 2/125
6,195,802 B1 * 3/2001 Armellino ..... 2/102

* cited by examiner

*Primary Examiner*—John J. Calvert
*Assistant Examiner*—Alissa L Hoey
(74) *Attorney, Agent, or Firm*—Greenblum & Bernstein, P.L.C.

(57) ABSTRACT

A garment adapted to cover the body of a wearer at least partially and including a covering for one or more of the extremities of the user. Depending upon the type of garment, such covering(s) can include a collar and/or sleeves and/or legs. The garment includes at least one comfort element, fixedly attached to the peripheral ends of at least one of the extremity covering(s), and extending beyond these ends so as to be in contact, at least locally, with the skin of the neck and/or of the wrists and/or of the ankles of the user, and to provide the latter with a comfortable sensation when the garment is worn.

23 Claims, 4 Drawing Sheets

GARMENT HAVING A COMFORT ELEMENT

BACKGROUND OF THE INVENTION

1. Field of the Invention

The present invention relates to a garment adapted to cover the body at least partially and including, in a conventional manner, depending on the type of garment, a collar and/or sleeves and/or legs, depending upon whether it is a garment for the upper body or for the lower body, in other words, a jacket, an anorak, a parka, a shirt, etc., or yet trousers. The garment according to the invention can also be overalls combining a collar, sleeves and legs.

2. Description of Background and Relevant Information

With respect to the collar of a garment, it is known to attach to the collar a second collar, the second collar lining the first over its entire periphery, as described, e.g., in French Patent Publication No. 2 737 646.

Although this does indeed improve the thermal characteristics of the garment in the area of the collar, it is however necessary to provide a means for storage of this second removable collar. Furthermore, in certain situations, the second collar can impart too much heat to the collar, i.e., to the neck of the wearer.

It is also known, from International Publication WO 99/00029, to attach within the garment, in this case a jacket, a sort of front internal lining for the lateral flaps of the jacket on both sides of the jacket opening, and including at its upper portion a collar which takes the form of a lining of the collar itself, as with the garment of the French document.

Such a garment is complicated to make, increasing its cost.

SUMMARY OF THE INVENTION

An object of the present invention is to overcome the aforementioned and other disadvantages and, to this end, the invention relates to a garment adapted to cover the body at least partially and it includes covering(s) for a wearer's extremities. Depending upon the type of garment embodying the invention, such coverings can include a collar and/or sleeves and/or legs. Further, such covering(s) include(s) at least one comfort element, fixedly attached to the peripheral end of at least one of the covering(s), and extending beyond these end(s) so as to be in contact, at least locally, with the skin of the neck and/or of the wrists and/or of the ankles of the user, and to provide the user with a pleasant comfort sensation when the garment is worn.

The present invention also relates to the characteristics which will become apparent from the description that follows, and which must be considered separately or according to all of their possible technical combinations.

BRIEF DESCRIPTION OF DRAWINGS

This description, which is provided by way of a non-limiting example, will help to better understand how the invention can be embodied, with reference to the annexed drawings, in which.

DETAILED DESCRIPTION OF THE INVENTION

Figure 1:
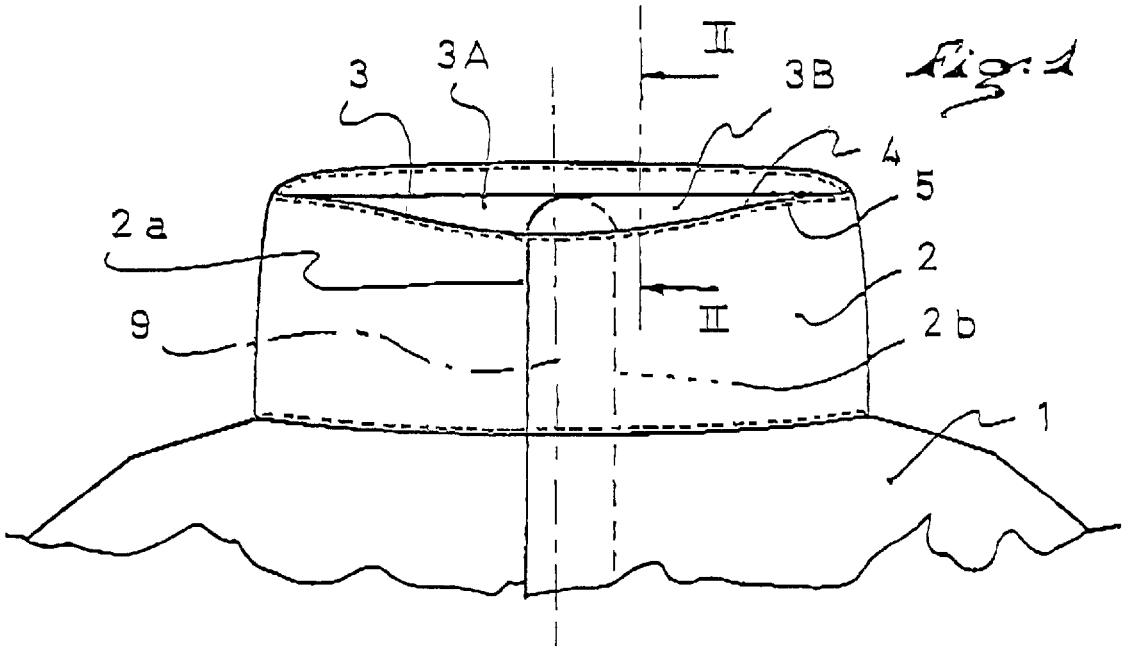
FIG. 1 is a front view of a comfort element according to the invention, arranged on the collar of a garment according to a particular non-limiting embodiment of the invention.

By way of a non-limiting example of the invention, a jacket 1 shown partially in FIG. 1 includes, at its upper end portion, a collar 2 on which a comfort element 3 is fixedly attached.

This comfort element 3 is attached to the peripheral end 4 of the collar 2 and extends beyond the end 4 so as to be in contact, at least locally, with the skin of the user's neck, according to the illustrated embodiment, and to provide the wearer with a pleasant sensation when wearing the garment 1, according to the effect sought by the invention. That is, the comfort element provides a more pleasant, or comfortable, sensation to the user than that which would be provided with the garment if it were not provided with hie invention.

As clearly shown in FIG. 1, and still according to the particular embodiment, the comfort element 3 is arranged only in a front zone of the collar 2, although it could also be arranged only in a rear zone, only in lateral zones, or throughout the entire periphery of the collar 2.

Figure 6:
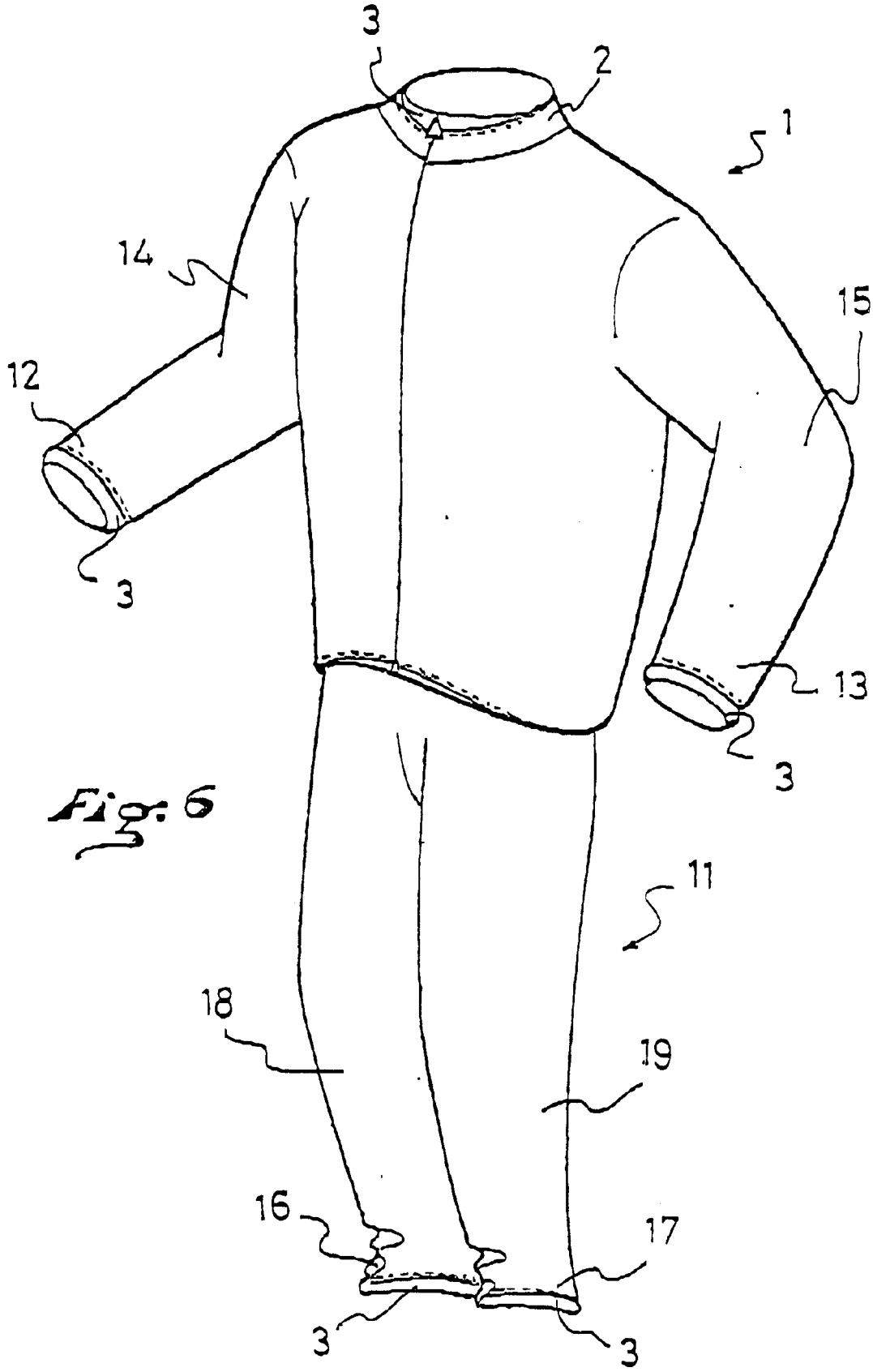
FIG. 6. illustrates, schematically an embodiment in which the invention is applied to a jacket and pants.

In the same way, as shown in FIG. 6, described below, the comfort element 3 could be provided at the end of the sleeves and/or legs of another type of garment for covering the extremities of the wearer, i.e., the arms and/or the legs.

Preferably, the comfort element 3 comprises a flexible pad attached to the selected end(s) 4 of the garment by means of a stitched seam 5 in the lower zone of the pad, within a hem 6, which may be plain or double, indifferently, made at the ends 4. Such stitching constitutes a permanent assembly, although other permanent assembly methods of attachment could also be used, such as adhesive or staples, for example. Alternatively, although permanent assembly of the pad to the collar is most preferred, it is also contemplated that the pad could be attached in a less permanent, or removable, manner. For this purpose, the pad, or each respective part of such pad, could be attached by means of a zipper, hook-and-loop fasteners, or snaps, for example.

Figure 2:
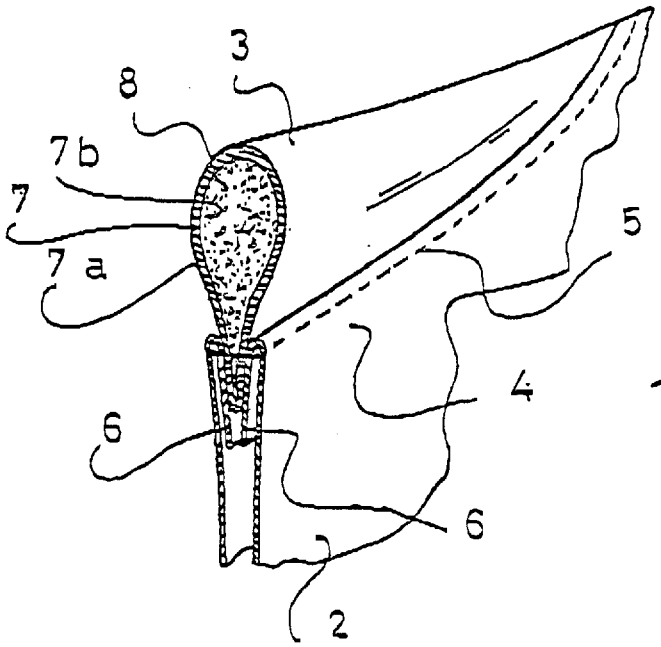
FIG. 2 is an enlarged cross-sectional view taken along the line II—II of FIG. 1.

As shown in greater detail in FIG. 2, the pad 3 comprises an envelope 7 enclosing a foam material 8 or three-dimensional filling, such as a compressible material, providing it with a flexible volume, The pad thereby constitutes a comfort cushion that is compressible and particularly comfortable. As seen in FIG. 2 and other figures of the drawing regarding other embodiments, the envelope 7 is folded, or rolled, at its peripheral edge or end (such as at the end of the lead line for reference numeral 2*e* in FIG. 4, for example) to form a continuous surface which might contact the user.

According to a first embodiment, the envelope 7 has an outer surface 7*a* made of a scraped fabric adapted to be in contact with the skin, whereas its inner surface 7*b* in contact with the foam has been coated with polyurethane, thereby constituting an impervious barrier.

According to a variation, the envelope 7 has an outer surface 7*a* made of a brushed fabric adapted to be in contact with the skin, whereas its inner surface 7*b* in contact with the foam has been coated with polyurethane, thereby constituting an impervious barrier, The brushed or scraped fabric provides a supplemental comfort element by the softness to the touch which it provides. Furthermore, it does not attack the skin in a zone where there can be considerable friction, for example when turning the head. The terms "brushed" and "scraped" both refer to the fabric having undergone a mechanical treatment process to give the fabric, such as a woven or knitted fabric, ascertain appearance. The difference between the two treatments corresponds to their respective intensities. For example, fleece (such as Polartec, e,g.) is a knitted fabric that is "scraped" to the extent that it is not possible to see the pattern of the fabric. On the other hand, other fabrics are "brushed" to the extent that a smooth mechanical action or brushing process if performed to give such fabrics a velvet appearance.

According to yet another variation, the envelope 7 has an outer surface 7*a* made of scraped or brushed polyamide material or fabric adapted to be in contact with the skin, whereas its inner surface 7*b* in contact with the foam has been coated with polyurethane, thereby constituting an impervious barrier.

According to a still further variation, the envelope 7 has an outer surface 7*a* made of scraped or brushed polyester material or fabric adapted to be in contact with the skin, whereas its inner surface 7*b* in contact with the foam has been coated with polyurethane, thereby constituting an impervious barrier.

In the embodiment and variations described hereinabove, the polyurethane coating of the envelope 7 is optional.

Still according to the embodiment shown in FIG. 1, because the comfort element 3 is arranged in the front zone of the collar 2, this element is made in two portions 3A, 3B which are attached to the free peripheral end 4 of the latter, on both sides of a front opening line 9 of the garment 1.

The front opening line 9 is imaginary, inasmuch as it is on both sides of the lateral ends 2*a*, 2*b* of the collar 2 that the portions 3A and 3B, respectively, of the comfort element 3 are arranged. In this first embodiment shown, the pad 3 has a transverse cross section that decreases progressively from the front opening line 9 to the opposite end. Alternatively, the pad 3 could have a constant transverse section.

Figure 3:
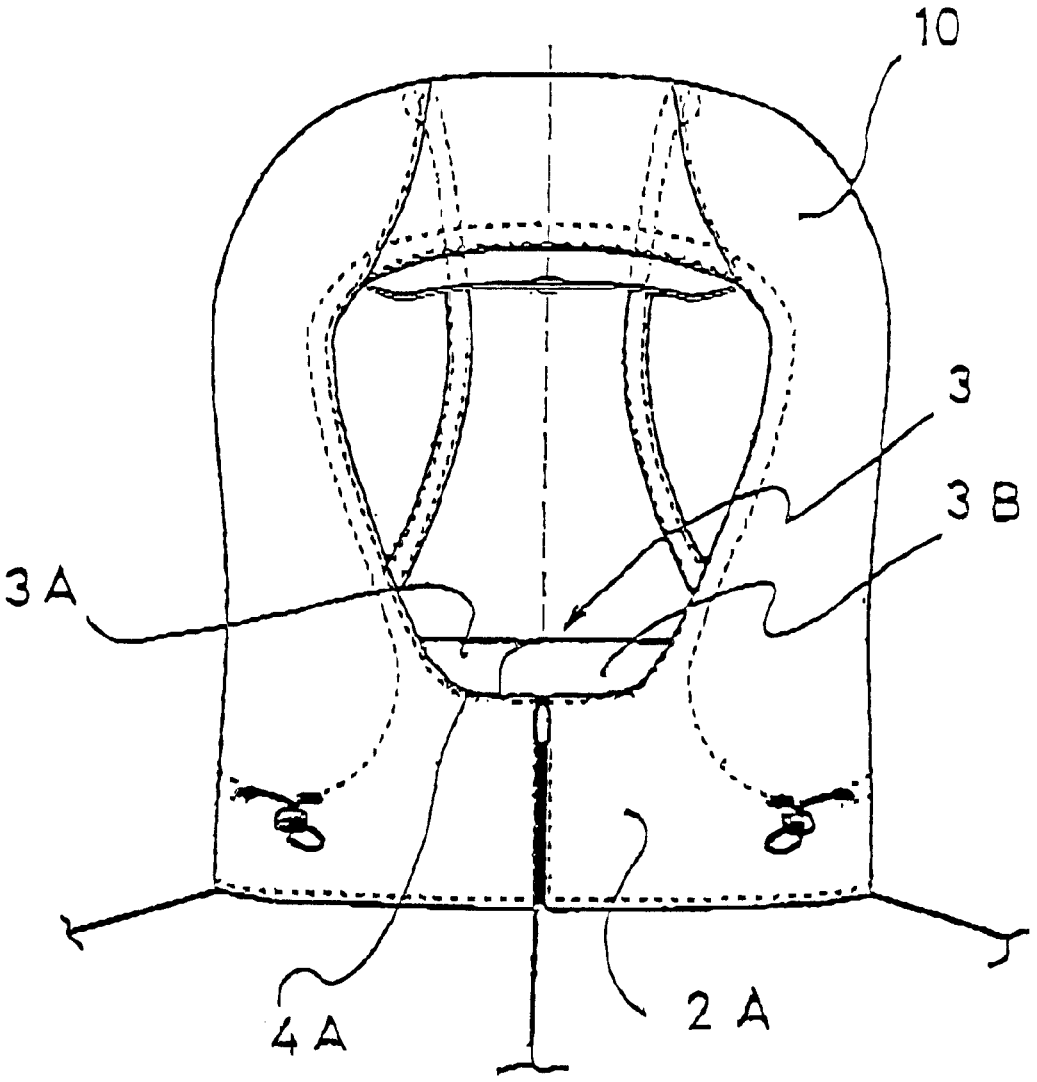
FIG. 3 is a front view of a comfort element according to the invention, arranged on a lower portion forming the collar of a hood.

According to a particular application of the invention shown in FIG. 3, the latter differs essentially from that of FIG. 1 in that the collar 2A is constituted of a lower portion of a hood 10. The portions 3A and 3B of the comfort element 3 are arranged in the same manner as described previously at the upper end 4A of the collar 2A.

In all of the cases described, the comfort element 3 can extend either over the entire periphery of the end of the garment, or on a portion thereof, as shown in particular in FIGS. 1 and 2.

Figure 4:
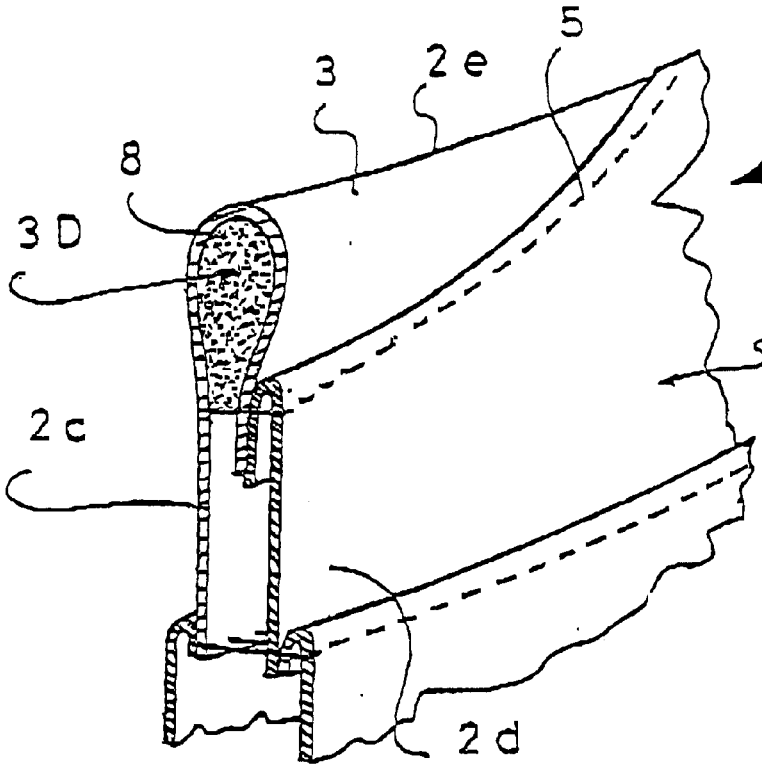
FIG. 4 is a view similar to FIG. 2 of a comfort element according to a second embodiment of the invention.

In a second embodiment of the invention, shown in FIG. 4, as an alternative to FIG. 2, e.g., the comfort element 3 is made partly of the same material as the peripheral end or collar 2. In this case, the collar 2 comprises an eternal fabric 2*d* and an internal fabric 2*c*, which can be either similar or different.

The comfort element 3 is made up by rolling the internal fabric over the collar edge 2*e*, until the external side 2*d* of the collar 2, thus forming a tube, wherein the foam or three-dimensional filling material will be introduced to form a compact element.

The end of this tube is stitched via a seam 5 to the internal fabric 2*c* of the collar 2. In this case the external material of the comfort element is the same as the material of the inside of the collar 2.

Figure 5:
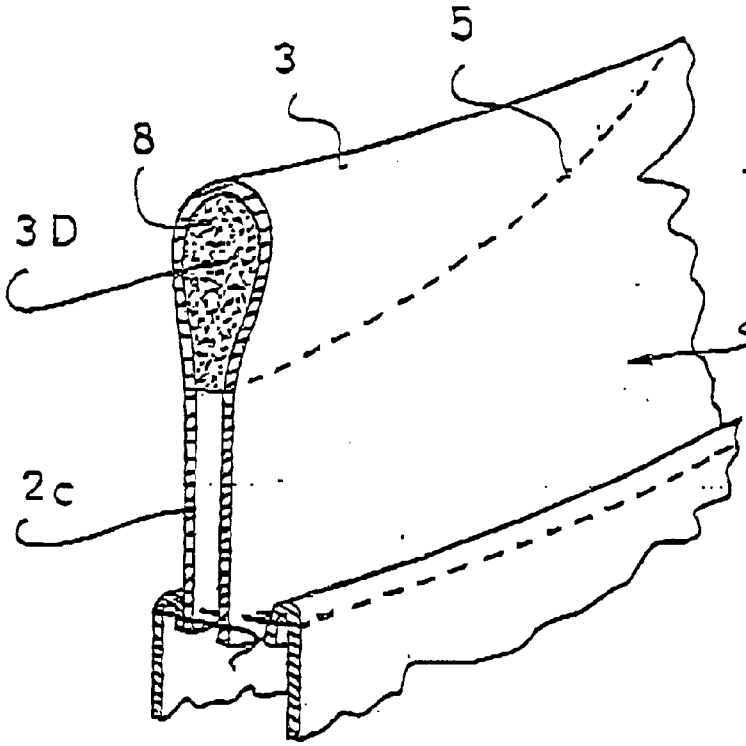
FIG. 5 is a view similar to FIG. 2 of a comfort element according to a third embodiment of the invention.

In a third embodiment of the invention, shown in FIG. 5, the entire collar 2, including the comfort element 3, is made up of the same external material 2*c*. In this case, the tube of the comfort element 3 is just made up via the stitching 5 and stuffing the tube with foam or three-dimensional filling material 8. In this embodiment, there is no need to create a special insert to make the comfort element.

In FIG. 6, a combined jacket 1 and pants 11 are illustrated. It is contemplated, according to the invention, that the peripheral ends 12, 13 of the sleeves 14, 15 of the jacket 1, and/or the peripheral ends 16, 17 of pant legs 18, 19 of the pants 11 can be constructed to have respective comfort elements 3 added in a manner according to the description above. Although the comfort elements 3 applied to the sleeves 14, 15 and pant legs 18, 19 are shown to extend around the entire peripheries of the ends of the sleeves and pant legs, it also contemplated that they could be constructed, alternatively, to extend around only part of such peripheries, as described above with regard to the comfort element 3 applied to the jacket collar 2.

What is claimed is:

1. A garment adapted to cover the body at least partially, said garment comprising:

an extremity covering adapted to extend peripherally around an extremity of a wearer, said extremity covering including an end periphery through which the wearer's extremity is adapted to extend, said extremity covering further comprising at least one substantially tubularly shaped comfort element having a filling of compressible material, said comfort element being fixedly attached to said end periphery of said extremity covering and having a rounded peripheral edge extending beyond said end periphery of said extremity covering so as to contact skin of the wearer at least locally, for providing the wearer with a comfort sensation;

said extremity covering comprising a collar having said end periphery to extend peripherally around the wearer's neck, said comfort element being made in two portions fixedly attached to a front zone of said collar on both sides of a front opening line of the garment.

2. A garment according to claim 1, wherein said comfort element is arranged only in a front, rear or peripheral zone of said end periphery of said extremity covering.

3. A garment according to claim 1, wherein said comfort element comprises a pad made of flexible material, said pad being attached to at least one certain selected portion of said end periphery of said extremity covering by means of a stitched seam.

4. A garment according to claim 3, wherein, said compressible material comprises a compressible foam material, and wherein said pad is constituted by an envelope enclosing said foam material, said foam material providing said pad with a flexible volume.

5. A garment according to claim 4, wherein said envelope has an outer surface made of a scraped fabric adapted to be in contact with the skin of the wearer, said envelope having an inner surface in contact with said foam material, said inner surface being coated with polyurethane constituting an impervious barrier.

6. A garment according to claim 4, wherein said envelope has an outer surface made of a brushed fabric adapted to be in contact with the skin of the wearer, said envelope having an inner surface in contact with said foam material, said inner surface being coated with polyurethane constituting an impervious barrier.

7. A garment according to claim 4, wherein said envelope has an outer surface made of polyamide material adapted to be in contact with the skin of the wearer, said envelope having an inner surface in contact with said foam material, said inner surface being coated with polyurethane constituting an impervious barrier.

8. A garment according to claim 4, wherein said envelope has an outer surface made of a polyester material adapted to be in contact with the skin of the wearer, said envelope having an inner surface in contact with said foam material, said inner surface being coated with polyurethane constituting an impervious barrier.

9. A garment adapted to cover the body at least partially, said garment comprising:

an extremity covering adapted to extend peripherally around an extremity of a wearer, said extremity covering including an end periphery through which the wearer's extremity is adapted to extend, said extremity covering further comprising at least one comfort element having a filling of compressible material, said comfort element being fixedly attached to said end periphery of said extremity covering and extending beyond said end periphery so as to contact skin of the wearer at least locally, for providing the wearer with a comfort sensation, said extremity covering further comprising a collar having an end periphery to extend peripherally around the wearer's neck, said comfort element being made in two portions fixedly attached to a front zone of said collar on both sides of a front opening line of the garment, said garment further comprising a hood extending from said collar, said hood having a front opening, said comfort element extending locally from said end periphery at a front of said collar.

10. A garment according to claim 1, wherein said comfort element is fixedly attached to said end periphery of said extremity covering by means of a permanent attachment.

11. A garment according to claim 10, wherein said permanent attachment comprises at least one stitched seam.

12. A garment according to claim 1, wherein:

said garment is a jacket and said extremity covering is a collar adapted to extend around the neck of a wearer.

13. A garment according to claim 12, wherein:

said jacket comprises a pair of sleeves, each of said pair of sleeves includes a respective peripheral end; and additional ones of said comfort elements are affixed to and extend beyond respective ones of said peripheral ends of said sleeves.

14. A garment according to claim 1, wherein:

said garment is a pair of pants having two pant legs, each of said pant legs having respective peripheral ends, said extremity covering is one of said two pant legs; and a second of said pant legs constitutes a second said extremity covering, and a second said comfort element is fixedly attached to and extends beyond said peripheral end of said second of said pant legs.

15. A garment according to claim 1, wherein said peripheral edge of said substantially tubularly shaped comfort element is free of seams.

16. A garment adapted to cover the body at least partially, said garment comprising:

an extremity covering adapted to extend peripherally around an extremity of a wearer, said extremity covering including an end periphery through which the wearer's extremity is adapted to extend, said extremity covering farther comprising at least one comfort element having a rounded outermost periphery and an interior with a filling of compressible material, said comfort element being fixedly attached to said end periphery of said extremity covering, said rounded outermost periphery being free of seams and extending beyond said end periphery in a determinate fixed orientation with respect to said end periphery so as to contact skin of the wearer at least locally, for providing the wearer with a comfort sensation;

said garment being a jacket and said extremity covering being a collar adapted to extend around the neck of a wearer;

said determinate fixed orientation being a generally upwardly extending orientation, said comfort element being self-supported in said generally upwardly.extending orientation from said end periphery of said extremity covering;

said garment having a generally vertically extending front opening;

said collar having an end periphery to extend peripherally around the wearer's neck;

said comfort element being made in two portions fixedly attached to a front zone of said collar, each of said two portions of said comfort element being positioned on a respective opposite side of said front opening.

17. A garment according to claim 16, wherein:

said comfort element is formed by a folded envelope, said folded envelope forming said outermost periphery for said comfort element.

18. A garment according to claim 16, wherein:

said comfort element is secured by stitching in said generally upwardly extending fixed orientation.

19. A garment adapted to cover the body at least partially, said garment comprising:

an extremity covering adapted to extend peripherally around an extremity of a wearer, said extremity covering including an end periphery through which the wearer's extremity is adapted to extend, said extremity covering further comprising two elements: a comfort element having a filling of compressible material and a covering, said comfort element being fixedly attached at said end periphery of said extremity covering to said covering and extending beyond an end periphery of said covering so as to contact skin of the wearer at least locally, for providing the wearer with a comfort sensation.

20. A garment according to claim 19, wherein said comfort element comprises two distinct portions extending around less than an entirety of the extremity of the wearer.

21. A garment according to claim 19, wherein said comfort element is stitched to said extremity covering, thereby defining an envelope within which said filling is located.

22. A garment according to claim 19, wherein said extremity covering comprises a collar having said end periphery to extend peripherally around the wearer's neck, said filling of compressible material being positioned only within an interior of said comfort element.

23. A garment according to claim 19, wherein said extremity covering comprises a collar having said end periphery to extend peripherally around the wearer's neck, said comfort element being made in two portions fixedly attached to a front zone of said collar on both sides of a front opening line of the garment.

* * * * *